US007479866B2

(12) United States Patent
Goldsberry et al.

(10) Patent No.: US 7,479,866 B2
(45) Date of Patent: Jan. 20, 2009

(54) LOW PROFILE AUTOMOTIVE FUSE

(75) Inventors: Timothy R. Goldsberry, Orland Hills, IL (US); Edwin Jay Harris, Oak Park, IL (US)

(73) Assignee: Littelfuse, Inc., Des Plaines, IL (US)

( * ) Notice: Subject to any disclaimer, the term of this patent is extended or adjusted under 35 U.S.C. 154(b) by 329 days.

(21) Appl. No.: 11/076,101

(22) Filed: Mar. 7, 2005

(65) Prior Publication Data

US 2005/0212647 A1 Sep. 29, 2005

Related U.S. Application Data

(60) Provisional application No. 60/550,682, filed on Mar. 5, 2004.

(51) Int. Cl.
*H01H 85/165* (2006.01)
*H01H 85/044* (2006.01)

(52) U.S. Cl. ..... 337/198; 337/186; 337/187

(58) Field of Classification Search ..... 337/198, 337/186, 187; 29/623
See application file for complete search history.

(56) References Cited

U.S. PATENT DOCUMENTS

| | | | | |
|---|---|---|---|---|
| 1,491,905 | A | | 4/1924 | Eustice |
| 2,308,435 | A | | 1/1943 | Wood |
| 2,863,967 | A | | 12/1958 | Swain |
| 3,189,712 | A | | 6/1965 | Kozacka |
| 3,261,950 | A | | 7/1966 | Kozacka |
| 3,301,978 | A | | 1/1967 | Kozacka |
| 3,529,271 | A | | 9/1970 | Swain |
| 3,775,723 | A | * | 11/1973 | Mamrick et al. ..... 337/245 |
| 3,786,402 | A | | 1/1974 | Horecky |
| 3,909,767 | A | | 9/1975 | Williamson et al. |
| 3,935,553 | A | | 1/1976 | Kozacka et al. |
| 4,056,884 | A | | 11/1977 | Williamson et al. |
| 4,059,334 | A | | 11/1977 | Bailey |
| 4,099,828 | A | | 7/1978 | Stegmaier et al. |
| 4,131,869 | A | * | 12/1978 | Schmidt et al. ..... 337/264 |
| 4,203,200 | A | | 5/1980 | Wiebe |
| 4,221,455 | A | | 9/1980 | Cairns et al. |
| 4,221,456 | A | | 9/1980 | Cairns et al. |

(Continued)

FOREIGN PATENT DOCUMENTS

GB 2090081 6/1982

OTHER PUBLICATIONS

International Search Report for International Patent Application No. PCT/US05/07484.

*Primary Examiner*—Anatoly Vortman
(74) *Attorney, Agent, or Firm*—Bell, Boyd & Lloyd LLP

(57) ABSTRACT

An automotive blade-type fuse and method of manufacturing same are provided. The fuse includes a pair of metallic terminals separated by and in electrical communication with a fuse element. An insulative housing is provided that covers at least a portion of an inner edge of each of the terminals and exposes the outer edges of the terminals and at least a portion of the upper edges of the terminals. The terminals can define grooves that interface with projections extending inwardly from the housing to hold the terminals firmly within the housing. Also, the upper edges of the terminals are bent inward to crimp the housing between an intermediate portion of the terminals and the bent upper end edges.

10 Claims, 5 Drawing Sheets

U.S. PATENT DOCUMENTS 4,224,592 A 9/1980 Urani et al.
4,300,281 A 11/1981 Panaro
4,344,058 A 8/1982 Knapp, Jr. et al.
4,349,804 A * 9/1982 Gaia ..... 337/198
4,365,226 A * 12/1982 Barry et al. ..... 337/198
4,375,630 A 3/1983 Gaia
4,391,485 A 7/1983 Urani
4,414,526 A 11/1983 Panaro
4,417,225 A 11/1983 Müller et al.
4,434,548 A 3/1984 Beswick
4,499,447 A 2/1985 Greenberg
4,500,162 A 2/1985 Keglewitsch et al.
4,504,816 A 3/1985 Viola et al.
4,544,907 A 10/1985 Takano
4,592,613 A 6/1986 Tong
4,604,602 A 8/1986 Borzoni
4,670,729 A 6/1987 Oh
4,675,990 A 6/1987 Viola et al.
4,682,140 A 7/1987 Diaz-Noriega
4,698,294 A 10/1987 Lau et al.
4,712,081 A 12/1987 Bosley
4,722,701 A 2/1988 Bradt
4,724,606 A 2/1988 Sexton, Jr.
4,782,317 A 11/1988 Thwaites
4,827,238 A 5/1989 Kozel
4,831,353 A * 5/1989 Gaia et al. ..... 337/255
4,884,050 A 11/1989 Kozel
4,949,062 A 8/1990 Mollet
4,949,063 A 8/1990 Levko
4,951,026 A 8/1990 Ehlmann
4,958,426 A 9/1990 Endo et al.
4,972,170 A 11/1990 Ehlmann et al.
4,986,767 A 1/1991 Kozel
4,992,770 A 2/1991 Spalding et al.
4,994,779 A 2/1991 Douglass
4,998,086 A 3/1991 Kourinsky et al.
5,049,095 A 9/1991 Gugelmeyer
D321,683 S 11/1991 Marach
5,075,664 A 12/1991 Spalding et al.
5,077,534 A 12/1991 Douglass
5,085,600 A 2/1992 Damron
5,118,314 A 6/1992 Mangone et al.
5,139,443 A 8/1992 Armando
5,227,759 A 7/1993 Hatagishi
5,228,188 A 7/1993 Badihi et al.
5,229,739 A 7/1993 Oh et al.
5,235,306 A 8/1993 Kalra et al.
5,239,282 A 8/1993 Filomia
5,239,291 A 8/1993 Henricks et al.
5,249,985 A 10/1993 Obenauer
5,293,147 A 3/1994 Oh et al.
5,296,832 A 3/1994 Perreault et al.
5,324,214 A 6/1994 De Castro
5,343,185 A 8/1994 Mosesian et al.
5,346,411 A 9/1994 Nikkinen
5,357,234 A 10/1994 Pimpis et al.
5,373,278 A 12/1994 Saulgeot et al.
5,426,411 A 6/1995 Pimpis et al.
5,444,428 A 8/1995 Carr et al.
5,476,395 A 12/1995 Raffles et al.
5,476,396 A 12/1995 De Castro
5,507,669 A 4/1996 Jannett et al.
D373,570 S 9/1996 Kudo et al.
5,552,757 A 9/1996 Blecha et al.
5,581,225 A 12/1996 Oh et al.
5,598,138 A 1/1997 Jaronczyk, Jr.
5,629,664 A 5/1997 Muramatsu et al.
5,662,496 A 9/1997 Kanamori
5,668,521 A 9/1997 Oh et al.
5,726,621 A 3/1998 Whitney et al.
5,736,918 A 4/1998 Douglass
5,818,320 A 10/1998 Matsuoka
5,847,635 A 12/1998 Kudo
5,854,583 A 12/1998 Falchetti
5,898,357 A 4/1999 Endo et al.
5,905,426 A 5/1999 Douglass
5,923,240 A 7/1999 Endo et al.
5,929,740 A 7/1999 Oh et al.
5,951,328 A 9/1999 Roper, Jr.
5,963,122 A 10/1999 Endo et al.
5,963,123 A 10/1999 Douglass
6,002,322 A 12/1999 Krueger et al.
6,011,458 A 1/2000 Endo et al.
6,031,446 A 2/2000 Prohaska et al.
6,075,689 A 6/2000 Mitchell
6,157,287 A 12/2000 Douglass et al.
6,163,244 A 12/2000 Endo et al.
6,168,471 B1 1/2001 Santa Cruz et al.
6,194,989 B1 2/2001 Douglass
6,222,438 B1 4/2001 Horibe et al.
6,272,000 B1 8/2001 Spaunhorst et al.
6,294,978 B1 9/2001 Endo et al.
D451,889 S * 12/2001 Ohashi et al. ..... D13/161
6,326,878 B1 12/2001 Liang
D452,851 S 1/2002 Ohashi et al.
D454,842 S 3/2002 Ohashi et al.
6,359,543 B2 * 3/2002 Endo et al. ..... 337/198
6,407,657 B1 6/2002 Oh
6,445,563 B1 9/2002 Endo
6,452,474 B1 9/2002 Oh
6,461,171 B2 10/2002 Kanaoka et al.
6,496,096 B2 * 12/2002 Kondo et al. ..... 337/234
6,529,113 B2 3/2003 Endo et al.
6,531,949 B2 3/2003 Endo et al.
6,542,064 B2 4/2003 Endo et al.
6,545,585 B2 * 4/2003 Endo et al. ..... 337/260
6,556,120 B2 4/2003 Endo et al.
6,556,121 B2 4/2003 Endo et al.
6,616,484 B1 9/2003 Fan Wong
6,622,375 B1 9/2003 Endo
6,642,834 B1 11/2003 Oh et al.
6,666,722 B2 12/2003 Fukumori et al.
6,666,723 B2 12/2003 Fukumori et al.
6,726,506 B2 4/2004 Fukumori et al.
6,734,780 B2 5/2004 Endo et al.
6,753,753 B2 6/2004 Endo et al.
6,771,477 B2 8/2004 Milanczak
6,848,946 B2 2/2005 Vicenza et al.
2001/0026209 A1 10/2001 Kondo et al.

* cited by examiner

LOW PROFILE AUTOMOTIVE FUSE

PRIORITY CLAIM

This application claims priority to and the benefit of U.S. Provisional Patent Application "LOW PROFILE AUTOMOTIVE FUSE," Ser. No. 60/550,682, Filed Mar. 5, 2004.

BACKGROUND OF THE INVENTION

The present invention relates to fuses and more particularly to automotive fuses.

Automotive fuses, such as blade type fuses are known in the art. Modern electrical blade fuses have been manufactured by Littelfuse, Inc., the assignee of the present invention. Blade fuses protect electrical automotive circuits from current overloads. The protection results from the creation of an opening of a fuse element of the fuse, and therefore in the circuit protected by the fuse. Upon a current overload of a certain magnitude and over a predetermined length of time the fuse element or link breaks or opens.

Blade fuses are used extensively in automobiles. Automobile manufacturers are constantly looking for ways to reduce costs as much as possible. Manufacturers strive to reduce costs, such as material and manufacturing costs, as much as possible. Automobile manufacturers on the other hand are constantly adding more electrical devices and accessories to automobiles. Consequently, automobile circuits having increasingly higher operating voltages. Sixty volt systems for example, are being contemplated and implemented. Higher ratings require more robust conductive elements and more insulation. The trend towards saved rather than lower cost therefore competes against the trend towards higher capacity.

Known blade fuses employ: (i) an insulative housing; (ii) conductive male terminals that fit into female terminals extending from the automobile's fuse block; and (iii) a fuse element connecting the male terminals. The male terminals have typically extended below the insulative housing. When installed in the fuse block, the housing of the fuse sits above the female terminals. The housing in such configuration and placement provides a convenient apparatus or area of the fuse to be grasped and pulled or pushed to remove or replace the fuse, respectively.

In known blade-type fuses, the upper portions of the male terminals, which reside within the housing, provide suitable places to which to secure the insulative housing to the terminals or metal portions of the fuse. Because the upper parts of the terminals sit above the fuse block, the upper parts can be used to define holes, for example, through which the housing is anchored. One common process for attaching the insulative housing to the metal terminals is called a "staking" process. In a heat staking process, heat is applied to the housing at points overlapping or aligned with the holes in the terminals. The applied heat melts or deforms the insulative housing so that the insulative material flows into the holes, hardens and thereafter holds the housing and the terminals together. Another staking method is commonly called a "cold stake", in which the material is deformed by mechanical force alone. No heat is used.

Recently, attempts have been made to reduce the amount of metal in blade-type fuses by eliminating the upper parts of the male terminals so that the resulting fuse fits primarily in between the female terminals of the fuse block and not significantly above the female terminals. One such "low profile" blade fuse is disclosed in U.S. Pat. No. 6,359,543. The fuse disclosed therein includes a housing that covers the top of the terminals but enables the outer sides of the terminals to be exposed. The exposed surfaces of the terminals are mated with the female terminals of the fuse block.

One concern facing all blade-type fuses arises when the fuse element opens. The opening of the fuse element coincides with a release of energy, including sound and heat. The air within the housing expands, placing stress on the housing and the attachment mechanisms holding the housing to the terminals. In certain instances if the housing is not properly attached to the terminals, the housing upon a short circuit can come free from the terminals or otherwise become difficult to remove from the fuse block.

The "low profile" fuse, while reducing the amount of metal and insulating material for a given rating, makes insertion and removal more cumbersome because there is less material exposed to grasp. Further, the reduced metal and insulative material reduces the area of overlap between the metal and the insulative material, making the staking or attachment process more difficult and less effective. The housings of known "low profile" fuses may therefore be more susceptible to dislodgement upon opening, creating a situation in which it is difficult to remove the male terminals of the fuse, which are friction fitted to the female terminals of the fuse block. This is especially true in the case of the "low profile" fuse because the male terminals do not extend significantly above the female terminals of the fuse block.

A need therefore exists for a "low profile" type fuse having a housing more securely attached to the terminal portions of the fuse to reduce the likelihood that the housing will become dislodged from the terminals when the fuse element opens.

A further need exists for a "low profile" type fuse that is readily removeable from the fuse block after an overcurrent condition occurs and the element opens.

SUMMARY OF THE INVENTION

The present invention includes an improved fuse and method of manufacturing same. In one embodiment, the fuse is a blade-type fuse, which can be used in automobiles. The fuse includes a pair of "low profile" terminals that can be male or female terminals. The fuse also includes an insulative housing that covers a portion but not all of the terminals. The housing is fixedly attached to the terminals so that the housing will not become dislodged from the terminals when the fuse element of the fuse opens due to an overcurrent condition.

In particular, the housing covers an inner portion of the terminals but exposes the outer edges and a portion of the top edge of the terminals. The housing is thereby able to be made using less material compared with known fuses. The terminals are also shortened with respect to known blade-fuse terminals. The "low profile" nature of the terminals is possible because the terminals do not have to extend beneath the housing, as present in typical blade fuses, to be capable of mating with female fuse block terminals.

The fuse of the present invention overcomes the potential problem of the housing becoming dislodged from the conductive portion of the fuse upon opening. The problem is solved by the present apparatus and method for more rigidly fastening the terminals to the housing. As illustrated below, a metal terminal portion of the fuse is provided. In the flat, the metal or conductive portion includes a pair of arms that each extend upwardly from the outer edge of either one of the terminals. After the housing is inserted over the metal portion of the fuse, the arms are bent inward, clamping or crimping the housing between the bent arms, which now form the upper edges of the terminals, while intermediate edges of the conductive terminals are housed within the insulative housing.

The bent upper edges provide a portion of the fastening function. The bent upper edges also provide probe points, which enable the user to test the integrity of the fuse. The housing in one embodiment is notched to receive the bent upper edges. The notch includes side walls that extend vertically above a portion of the bent upper end edges of the terminals to help mitigate the risk of an accidental arcing across the terminals.

The terminals and the housing can be made of a variety of materials as discussed herein. Further, the fuse link or fuse element connected electrically between the terminals can be of the same or different material as the terminals and can be sized for any suitable current rating.

The housing is ribbed or flanged to provide rigidity. The flanges contacting the terminals in one embodiment are staked to provide additional support and stability. In one embodiment, the terminals define apertures or indentations for enabling the hot or cold staked housing material to project into the terminals to further mechanically attach the housing to the conductive portion of the fuse.

A pair of holes and corresponding stakes is provided for each terminal in one embodiment. The holes and stakes are spaced apart vertically along the terminals. This configuration helps so that the weaker element does no bend inadvertently, enabling the terminals to pivot within the housing.

In another embodiment, the terminals are each vertically grooved. The housing provides corresponding elongated vertical ribs or projections that fit into the grooves to prevent the element from bending and the terminals from inadvertently pivoting about a horizontal axis through the fuse housing. This groove/rib configuration cooperates with or replaces the staking in one embodiment. The grooves in one embodiment are located on opposite sides of the terminals. This configuration also helps prevent the terminal portion of the fuse from pivoting about a vertical axis through the body. The grooves/projections also help to prevent translational movement of the terminal portion within the fuse housing in multiple directions.

It should be appreciated however that the bent upper edges provide a more secure attachment mechanism than known staking processes and staking is not required in the fuse of the present invention to properly fix the housing to the terminal portion of the fuse.

The terminal portion of the fuse in one embodiment is centered between the flat sides of the insulative housing. The centering mitigates the possibility that the housing will distort or melt upon opening of the fuse.

To the above described ends, in one embodiment, an automotive blade-type fuse is provided. The fuse includes a pair of metallic terminals separated by and in electrical communication with a fuse element. An insulative housing is provided that covers at least a portion of an inner edge of each of the terminals and exposes the outer edges of the terminals and at least a portion of the upper edges of the terminals. The upper edges of the terminals are bent inward to crimp the housing between an intermediate portion of the terminals and the bent upper end edges.

In one embodiment, the terminals each define an aperture and the housing is staked at portions covering the apertures in the terminals. The bent upper edges can be located so as to provide probe points from which the integrity of the fuse element can be tested.

The housing includes a top. The top defines notches that receive the bent upper edges. The top can extend outward from front and back faces of the housing to increase rigidity of the housing. Viewing the terminals and housing from the front, the top can also extend above the bent upper edges so as to provide protection against an inadvertent electrical connection across the bent upper edges. At least one of the front and back faces of the housing includes a projection that increases the rigidity of the housing.

In another primary embodiment of the present invention, an automotive blade-type fuse manufacturing method is provided and includes: (i) forming a pair of metallic terminals separated by and in electrical communication with a fuse element; (ii) covering at least a portion of an inner edge of each of the terminals with an insulative housing and exposing the outer edges of the terminals and at least a portion of the upper edges of the terminals; and (iii) bending the upper edges of the terminals inward and crimping the housing between a body portion of the terminals and the bent upper end edges.

In one embodiment, the housing is staked to at least one of the terminals. The bent upper edges provide probe points from which the integrity of the fuse element can be tested. The housing can be notched at locations receiving the bent upper edges and/or extended above the bent upper edges to provide protection against an inadvertent electrical connection across the bent upper edges.

It is therefore an advantage of the present invention to provide an improved fuse.

It is another advantage of the present invention to provide an improved method of making a fuse.

Moreover, it is an advantage of the present invention to provide a "low profile" type of fuse, in which the insulative housing is securely fastened to the metal portion without requiring staking.

It is a further advantage of the present invention to eliminate additional insulative material with respect to known "low profile" fuses.

Furthermore, it is an advantage of the present invention to provide an apparatus that secures the terminal portion of the fuse within the insulative housing in multiple translational directions and about multiple axes of rotation.

Still further, it is an advantage of the present invention to secure the terminal portion of the fuse within the insulative housing so that the terminal portion is at least substantially centered within the housing.

Additional features and advantages of the present invention are described in, and will be apparent from, the following Detailed Description of the Invention and the figures.

DETAILED DESCRIPTION OF THE INVENTION

Figure 1:
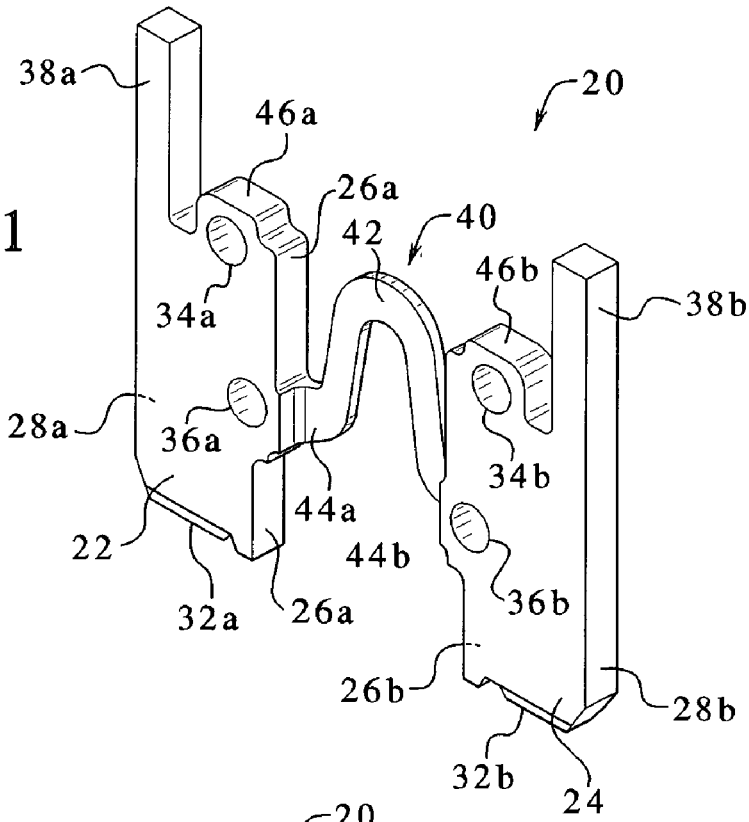
FIGS. 1 to 4 are perspective, top, front and side views, respectively, illustrating one embodiment of the conductive portion of the fuse of the present invention in an unbent condition.
Figure 2:
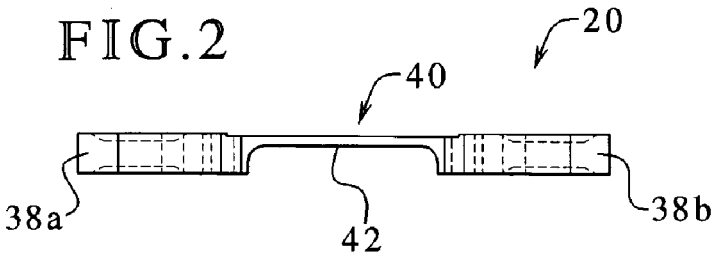
Figure 3:
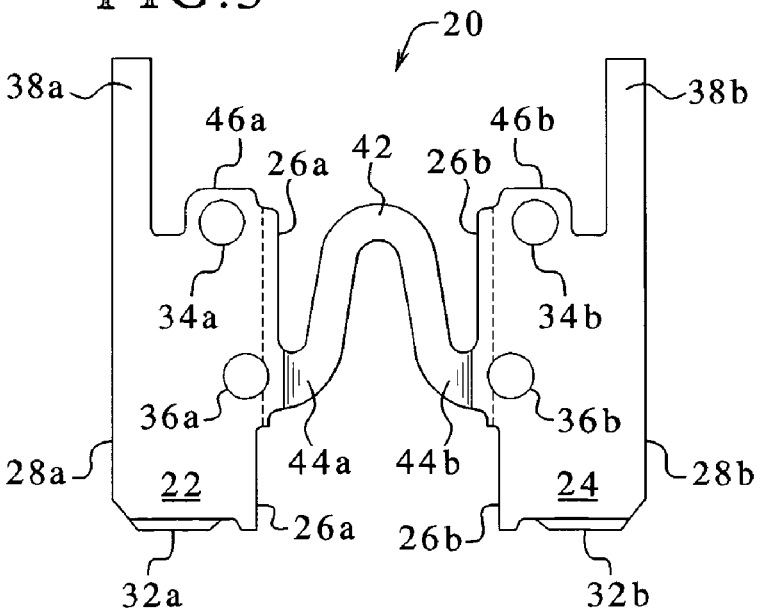
Figure 4:
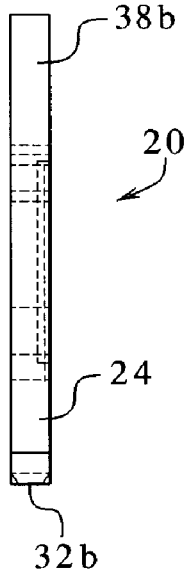
Figure 5:
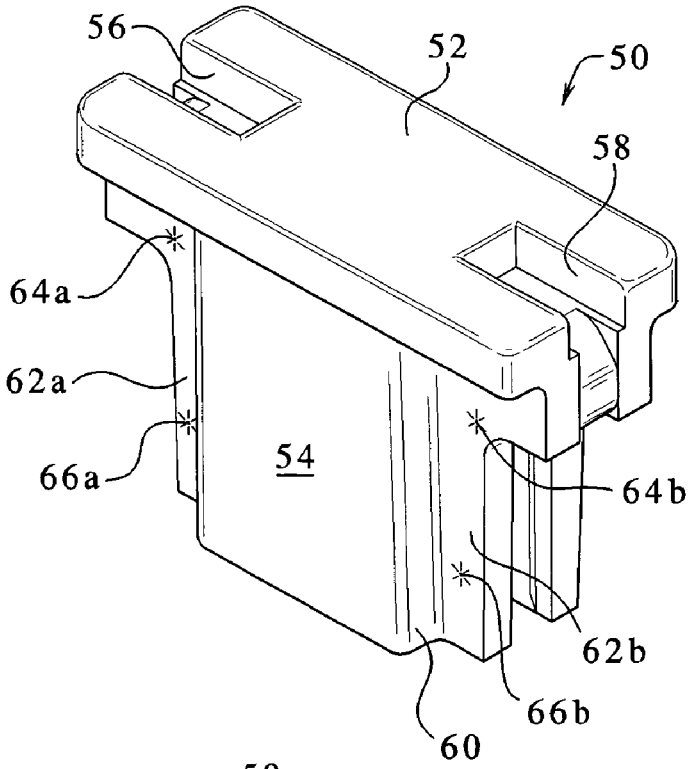
FIGS. 5 to 8 are perspective, top, front and side views, respectively, illustrating one embodiment of the insulative housing of the fuse of the present invention.
Figure 6:
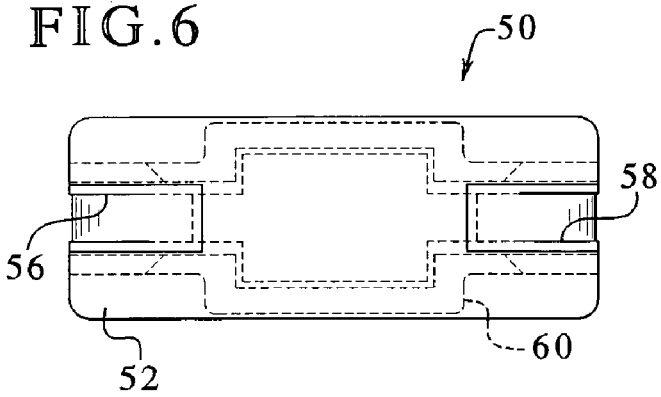
Figure 7:
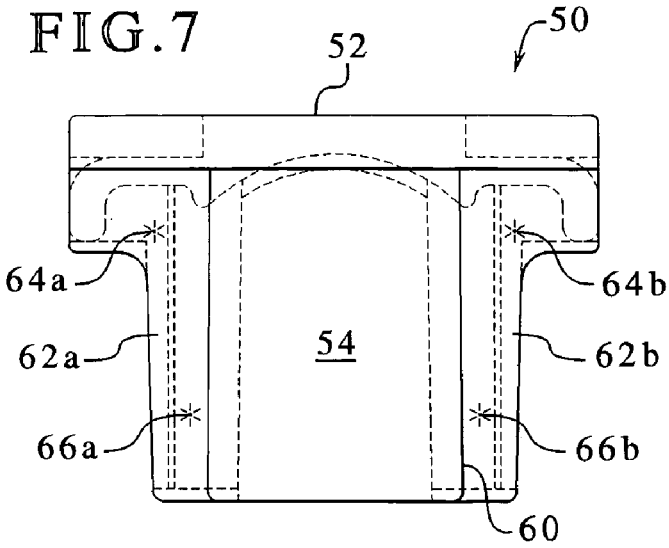
Figure 8:
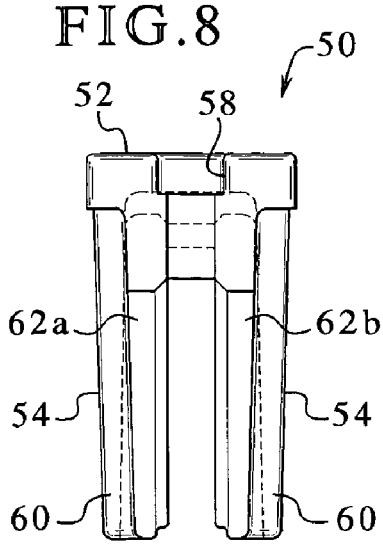
Figure 9:
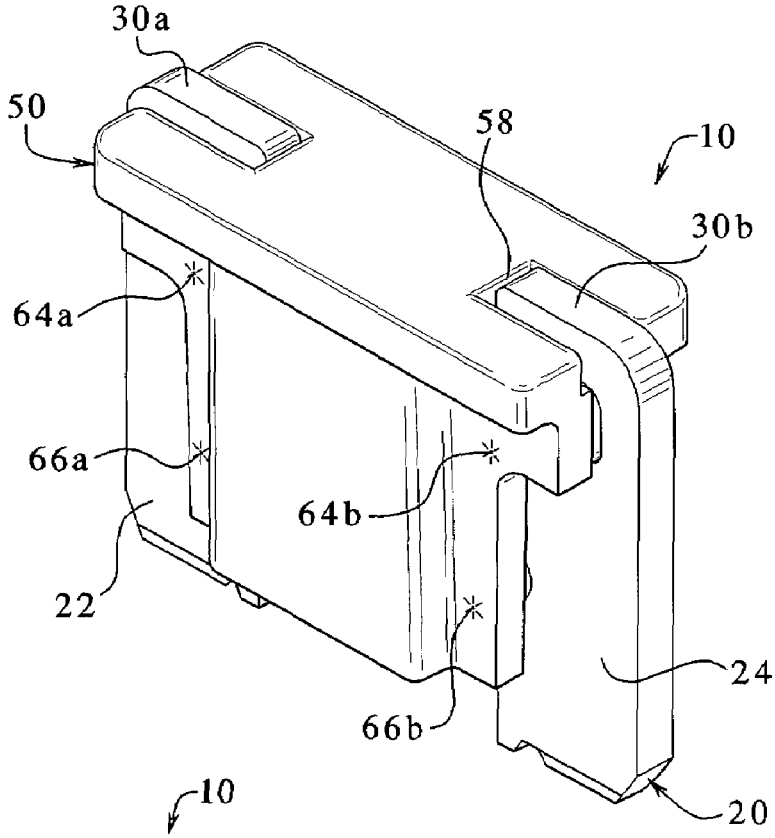
FIGS. 9 to 12 are perspective, top, front and side views, respectively, illustrating an assembled fuse using the apparatuses of FIGS. 1 to 8 of the present invention, wherein the legs of the terminal portion are now bent to provide a secure attachment.
Figure 10:
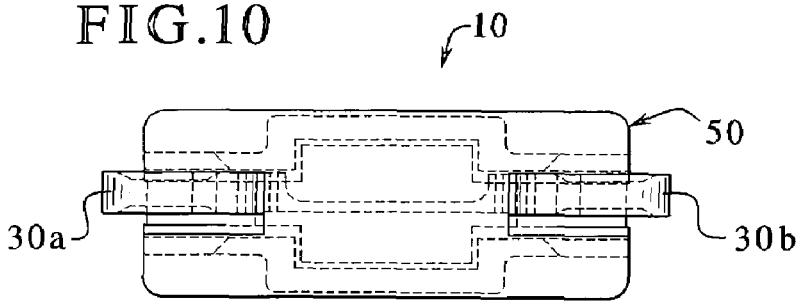
Figure 11:
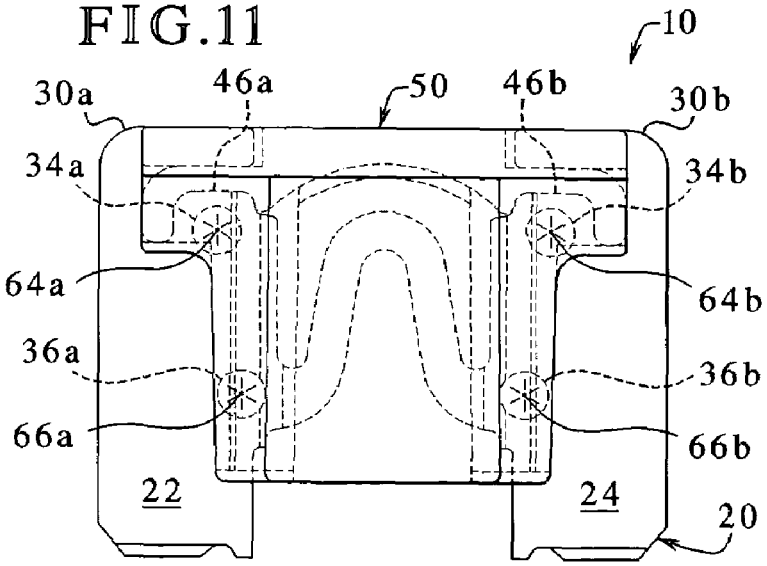
Figure 12:
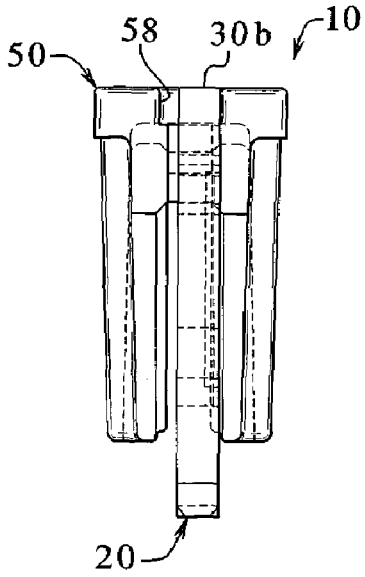
Figure 13:
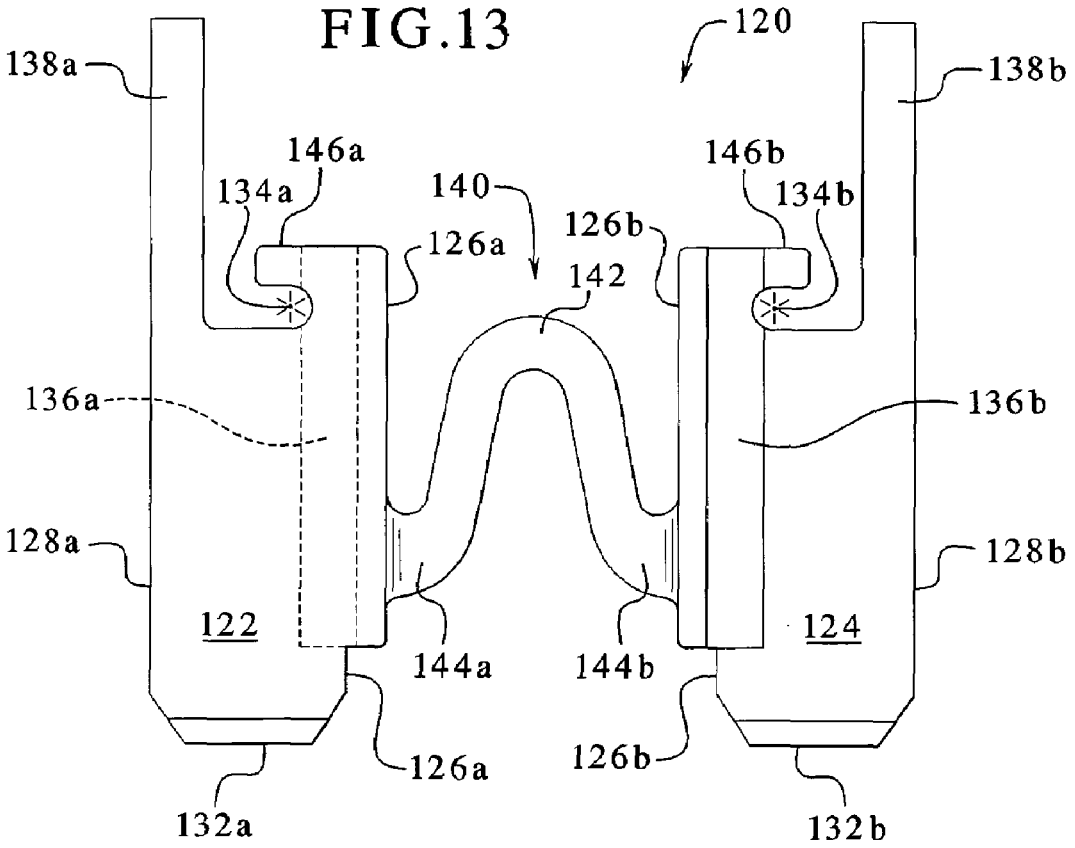
FIGS. 13 to 17 are front, top, bottom, side and perspective views, respectively, illustrating various views of another embodiment of the conductive portion, insulative housing and associated assembly of the fuse of the present invention.
Figure 14:
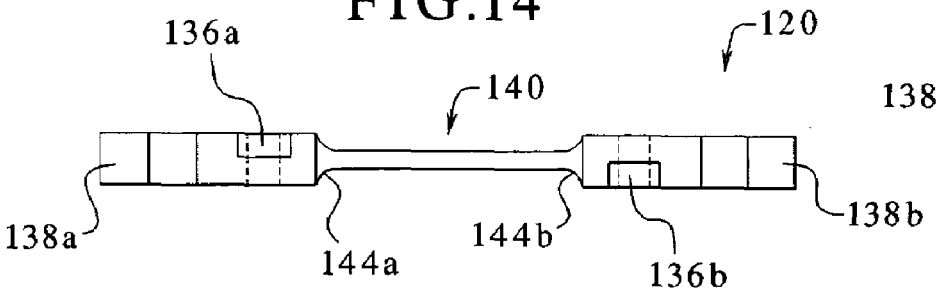
Figure 15:
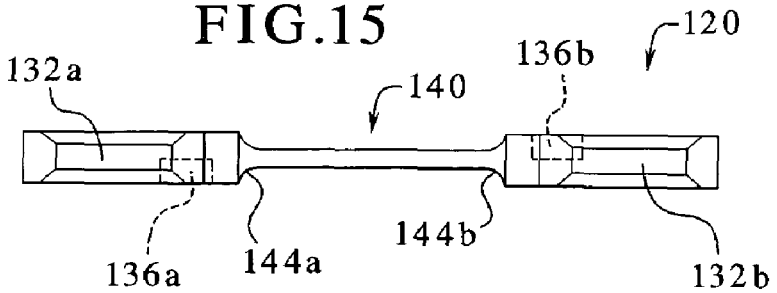
Figure 16:
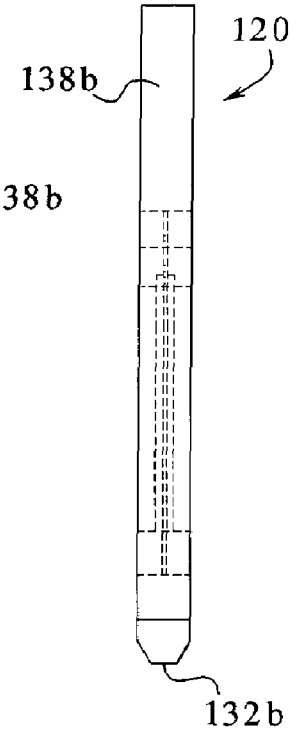

Referring now to FIGS. 1 to 12, one embodiment of a fuse 10 of the present invention is illustrated. Fuse 10 includes a conductive or metal portion 20 and an insulative housing 50. Conductive or metal portion 20 can be made of any suitable conductive material, such as metal. In various embodiments, conductive portion 20 is made of copper, aluminum, zinc, nickel, tin, gold, silver and any alloys or combinations thereof. In alternative embodiments, the conductive portion 20 or sections thereof can be plated with one or more metal or conductive plating.

Insulative housing 50 is made of any suitable plastic or non-conductive material. For example, housing 50 can be made of any of the following materials: polycarbonate, polyester, polyethylene, polypropylene, polystyrene, polyvinylchloride, polyvinylidene chloride, acrylic, nylon, phenolic, polysulfone and any combination or derivative thereof. In one embodiment, conductive portion 20 is stamped, wire electrical discharge machining ("EDM") cut, laser cut or otherwise formed by any suitable metal forming process. Housing 50 in one embodiment is injection molded or extrusion molded.

Metal portion 20 includes a pair of terminals 22 and 24. Terminals 22 and 24 are sized and shaped appropriately to be mated to a pair of female terminals (not illustrated) that extend from a fuse block, for example, a fuse block of an automobile. While fuse 10 is illustrated as a male-type blade fuse, the teachings of the present invention are not limited to: (i) a male fuse or (ii) a blade-type fuse. The present invention instead applies to any fuse for which an insulative housing, such as housing 50, is coupled or fastened to a conductive portion, such as portion 20.

Terminal 22 includes an inner edge 26*a*, an outer edge 28*a*, an upper edge 30*a* (FIGS. 9 to 12) and a lower edge 32*a*. Likewise, terminal 24 includes an inner edge 26*b*, outer edge 28*b*, an upper edge 30*b* (FIGS. 9 to 12) and a lower edge 32*b*. As seen, upper edge members 30*a* and 30*b* are bent over housing 50 and remain exposed and uncovered. Upper edges 30*a* and 30*b* double as fastening devices and probe points for a user to detect the integrity of a fuse element 40 linking terminals 22 and 24 electrically.

Terminal 22 defines an upper aperture 34*a* and a lower aperture 36*a*. Terminal 24 defines an upper aperture 34*b* and a lower aperture 36*b*. Apertures 34*a* and 34*b* and 36*a* and 36*b* are provided near the inner edges 26*a* and 26*b* of terminals 22 and 24, respectively, for purposes discussed below. As illustrated below in connection with FIGS. 13 to 19, the terminals can define a myriad of different types of apertures, notches or grooves for various functional purposes.

FIGS. 1 to 4 illustrate that metal portion 20 when in the flat defines or includes straight legs 38*a* and 38*b*. Those legs are bent over portions of housing 50 after housing 50 has been inserted onto metal portion 20. That bending or crimping process secures conductive or terminal portion 20 to insulative housing 50.

As discussed above, conductive portion 20 includes a fuse element or fuse link 40 that connects terminals 22 and 24 electrically. Fuse element or link 40 is illustrated as having an inverted "U" shaped portion 42, in which the ends of the "U" are connected respectively to terminals 22 and 24 via conductive interfaces 44*a* and 44*b*. Portion 42 of fuse link 40 alternatively has any desirable and functionally suitable shape, such as a "V"-shape, "M"-shape, "N"-shape, as well as others. As illustrated, link 40 can be thinned or contoured as needed to produce a fuse having desired electrical characteristics. In the illustrated embodiment, link 40 is coined, milled or otherwise machined on one surface or side, so that link 40 and conductive portion 20 are asymmetrical as seen best in FIG. 2. As discussed below, link 40 in an alternative embodiment is symmetrical with respect to the conductive portion, which may also be symmetrical.

Fuse element 40 can be made of the same or different type of material as terminals 22 and 24. Fuse element 40 and thus fuse 10 can be rated for any desirable amperage. For automotive uses, for example, element 40 and fuse 10 can be rated for 1 amp to 80 amps. For uses other than automotive uses, fuse 10 and element 40 can have different amperage ratings as desired.

Insulative housing 50 includes a top 52 and a body 54. As illustrated, top 52 defines notches 56 and 58 that receive bent upper end edges 30*a* and 30*b*, respectively, of terminal portion 20. Legs 38*a* and 38*b* of FIGS. 1 to 4 are crimped down on the surfaces of notches 56 and 58, trapping those surfaces and housing 50 between upper end edges 30*a* and 30*b* and intermediate edges 46*a* and 46*b* of terminals 22 and 24. That mechanical crimping provides a very secure attachment between the metal portion 20 and the housing 50. The crimped attachment should eliminate problems with housing 50 becoming dislodged from conductive portion 20 when fuse link 40 opens due to an overcurrent condition. Further, the process of bending legs 38*a* and 38*b* over notches 56 and 58 is a relatively simple process that can be performed with standard equipment. The surfaces defining notches 56 and 58 can be radiussed as illustrated to facilitate the bending process.

In one preferred embodiment, the surface of top 52 extends vertically above the top portions of upper edges 30*a* and 30*b*. That configuration aids in preventing a person from inadvertently creating an electrical path across upper edges 30*a* and 30*b*, for example, by laying a conductive instrument on top of fuse 10 or by pressing down on fuse 10 with one's finger. It should be appreciated however that upper end edges 30*a* and 30*b* remain exposed so that the edges can be used additionally as probes for determining the integrity of fuse 10.

While housing 50 covers at least a portion of the front and back surfaces of terminals 22 and 24 along inner edges 26*a* and 26*b*, housing 50 does not cover the front and rear surfaces of terminals 22 and 24 along the outer edges 28*a* and 28*b* and portions of the front and rear surfaces of terminals 22 and 24 at upper edges 30*a* and 30*b*. Because the housing 50 is securely attached to conductive portion 20 via upper edges 30*a* and 30*b*, the amount of dielectric material used for covering the element 40 and securing housing 50 to portion 20 is reduced. A majority of the surface area of terminals 22 and 24 is exposed in the illustrated embodiment, including the outer edges thereof, enabling the fuse to be inserted primarily between mating terminals of the fuse block as opposed to above the mating terminals.

Terminals 22 and 24 extend slightly below housing 50 as illustrated. In alternative embodiments, terminals 22 and 24 may be flush with the bottom of housing 50 or reside slightly above the housing.

Body 54 (on both sides) includes or defines outwardly extending projections 60. Each projection 60 extends outwardly on one side of housing 50 from insulative flange sections 62*a* and 62*b*. Flange section 62*a* covers the front and rear faces of terminal 22 along the inner edge 26*a* of terminal 22. Likewise, flange 62*b* covers the inner portions of the front and rear faces of terminal 24.

Flanges 62*a* and 62*b* include staking areas 64*a* and 66*a* and 64*b* and 66*b*, respectively. Those staking areas are provided on both sides of housing 50 in one embodiment. The areas are cold staked or otherwise heated to a temperature sufficient to melt or deform the insulative or plastic material of housing 50. Insulative material (cold staked or heated) extends into apertures 34*a*, 36*a*, 34*b* and 36*b* of terminals 22 and 24, respectively. The cold or hot staked material or solidifies, cools and/or hardens and provides further mechanical attachment between terminal portion 20 and housing 50.

It should be appreciated that staking is not required and that bent upper end edges 30*a* and 30*b* sufficiently hold housing 50 and conductive portion 20 together. However, for further support and to prevent pivoting of housing at the lower portion of terminals 22 and 24, staking can be done in one or more places. The staking tends to prevent element 40, which is thinner and weaker than the terminals, from bending inadvertently. This prevents terminals 22 and 24 from shifting translationally and from pivoting inwardly or outwardly about axes extending perpendicularly from the broad side of terminal portion 20. The staking also helps to stabilize conductive portion 20 laterally (front to back) within housing 50 and about an axis extending through the top of the fuse.

Although not illustrated, housing 50 can include or define a tab at its bottom that extends across the opening shown defined by housing 50. That tab helps to collect any residue from the opening of fuse element 40 upon an overcurrent condition.

Referring now to FIGS. 13 to 17, one preferred conductive portion 120 and associated housing 150 form fuse 100 of the present invention. Fuse 100 is similar in many respects to fuse 10. In particular, metal portion 120 includes a pair of terminals 122 and 124. Terminals 122 and 124 are sized and shaped appropriately to be mated to a pair of female terminals (not illustrated) that extend from a fuse block, for example, a fuse block of an automobile. While fuse 100 is illustrated as a male-type blade fuse, the teachings of the present invention are not limited to: (i) a male fuse or (ii) a blade-type fuse. The present invention instead applies to any fuse for which an insulative housing, such as housing 150, is coupled or fastened to a conductive portion, such as portion 120.

Terminal 122 includes an inner edge 126*a*, an outer edge 128*a*, an upper edge 130*a* (FIG. 17) and a lower edge 132*a*. Likewise, terminal 124 includes an inner edge 126*b*, outer edge 128*b*, an upper edge 130*b* (FIG. 17) and a lower edge 132*b*. As seen, upper edge members 130*a* and 130*b* are bent over housing 150 and remain exposed and uncovered. Upper edges 130*a* and 130*b* double as fastening devices and probe points for a user to detect the integrity of a fuse element 140 linking terminals 122 and 124 electrically.

Terminal 122 defines slot 134*a*. Terminal 124 defines slot 134*b*. Slots 134*a* and 134*b* are provided for staking purposes discussed below. The terminals can define a myriad of different types of apertures, notches or grooves for various functional purposes.

FIGS. 13 to 16 illustrate that metal portion 120 when in the flat defines or includes straight legs 138*a* and 138*b*. Those legs are bent over portions of housing 150 after housing 150 has been inserted onto metal portion 120. That bending or crimping process secures conductive or terminal portion 120 to insulative housing 150.

As discussed above, conductive portion 120 includes a fuse element or fuse link 140 that connects terminals 122 and 124 electrically. Fuse element or link 140 is illustrated as having an inverted "U"-shaped portion 142, in which the ends of the "U" are connected respectively to terminals 122 and 124 via conductive interfaces 144*a* and 144*b*. Portion 142 of fuse link 140 alternatively has any desirable and functionally suitable shape, such as a "V"-shape, "M"-shape, "N"-shape, as well as others. As illustrated, link 140 can be thinned or contoured as needed to produce a fuse having desired electrical characteristics. In the illustrated embodiment, link 140 is coined, milled or otherwise machined on two surfaces or sides, so that link 140 and conductive portion 120 are symmetrical as seen best in FIGS. 14 and 15. As discussed above, link 40 of fuse 10 in an alternative embodiment is asymmetrical with respect to conductive portion 20 (see FIG. 2).

Fuse element 140 can be made of the same or different type of material as terminals 122 and 124. Fuse element 140 and thus fuse 100 can be rated for any desirable amperage. For automotive uses, for example, element 140 and fuse 100 can be rated for 1 amp to 80 amps. For uses other than automotive uses, fuse 100 and element 140 can have different amperage ratings as desired.

Insulative housing 150 includes a top 152 and a body 154. As illustrated, top 152 defines notches 156 and 158 that receive bent upper end edges 130*a* and 130*b*, respectively, of terminal portion 120. Legs 138*a* and 138*b* of FIGS. 13 to 16 are crimped down on the surface of notches 156 and 158, trapping those surfaces and housing 150 between upper end edges 130*a* and 130*b* and intermediate edges 146*a* and 146*b* of terminals 122 and 124. That mechanical crimping provides a very secure attachment between the metal portion 120 and the housing 150. The crimped attachment should eliminate problems with housing 150 becoming dislodged from conductive portion 120 when fuse link 140 opens due to an overcurrent condition. Further, the process of bending legs 138*a* and 138*b* over notches 156 and 158 is a relatively simple process that can be performed with standard equipment. The surfaces defining notches 156 and 158 can be radiussed as illustrated to facilitate the bending process.

In one preferred embodiment, the surface of top 152 extends vertically above the top portions of upper edges 130*a* and 130*b*. That configuration aids in preventing a person from inadvertently creating an electrical path across upper edges 130*a* and 130*b*, for example, by laying a conductive instrument on top of fuse 100 or by pressing down on fuse 100 with one's finger. It should be appreciated however that upper end edges 130*a* and 130*b* remain exposed (front, back and top thereof) so that the edges can be used additionally as probes for determining the integrity of fuse 100.

While housing 150 covers at least a portion of the front and back surfaces of terminals 122 and 124 along inner edges 126*a* and 126*b*, housing 150 does not cover the front and rear surfaces of terminals 122 and 124 along the outer edges 128*a* and 128*b* and portions of the front and rear surfaces of terminals 122 and 124 at upper edges 130*a* and 130*b*. Because the housing 150 is securely attached to conductive portion 120 via upper edges 130*a* and 130*b*, the amount of dielectric material used for covering element 140 and securing housing 150 to portion 120 is reduced. A majority of the surface area of terminals 122 and 124 is exposed in the illustrated embodiment, including the outer edges thereof, enabling the fuse to be inserted primarily between mating terminals of the fuse block as opposed to being inserted above the mating terminals.

Terminals 122 and 124 extend slightly below housing 150 as illustrated. In alternative embodiments, terminals 122 and 124 may be flush with the bottom of housing 150 or reside slightly above the housing.

Body 154 (on both sides) includes or defines outwardly extending projections 160. Projections 160 extend outward on both sides of housing 150 from insulative flange sections 162*a* and 162*b*. Flange section 162*a* covers the front and rear faces of terminal 122 along the inner edge 126*a* of terminal 122. Likewise, flange 162*b* covers the inner portions of the front and rear faces of terminal 124.

Flanges 162*a* and 162*b* include staking areas 164*a* and 164*b*, respectively. Those staking areas are provided on both sides of housing 150 in one embodiment. The areas are cold staked or otherwise heated to a temperature sufficient to melt or deform the insulative or plastic material of housing 150.

Insulative material (cold staked or heated) extends into slots 134*a*, 134*b* of terminals 122 and 124, respectively. The cold or hot staked material solidifies, cools and/or hardens and provides further mechanical attachment between terminal portion 120 and housing 150.

It should be appreciated that staking is not required and that bent upper end edges 130*a* and 130*b* sufficiently hold housing 150 and conductive portion 120 together. However, for further support and to prevent pivoting of housing at the lower portion of terminals 122 and 124, staking can be done in one or more places. The staking tends to prevent element 140, which is thinner and weaker than the terminals, from bending inadvertently. This prevents terminals 122 and 124 from pivoting inwardly and outwardly about axes extending perpendicularly from the broad side of terminal portion 120. The staking also helps to stabilize conductive portion 120 laterally (front to back) within housing 150.

In the illustrated embodiment, terminals 122 and 124 of terminal portion 120 include or define grooves 136*a* and 136*b*, respectively. Grooves 136*a* and 136*b* can extend, e.g., half way into terminals. Grooves 136*a* and 136*b* in the illustrated embodiment are provided on opposing sides of terminal portion 120. Grooves 136*a* and 136*b* may be milled, stamped or otherwise formed into terminals 122 and 124 via any suitable method.

Figure 17:
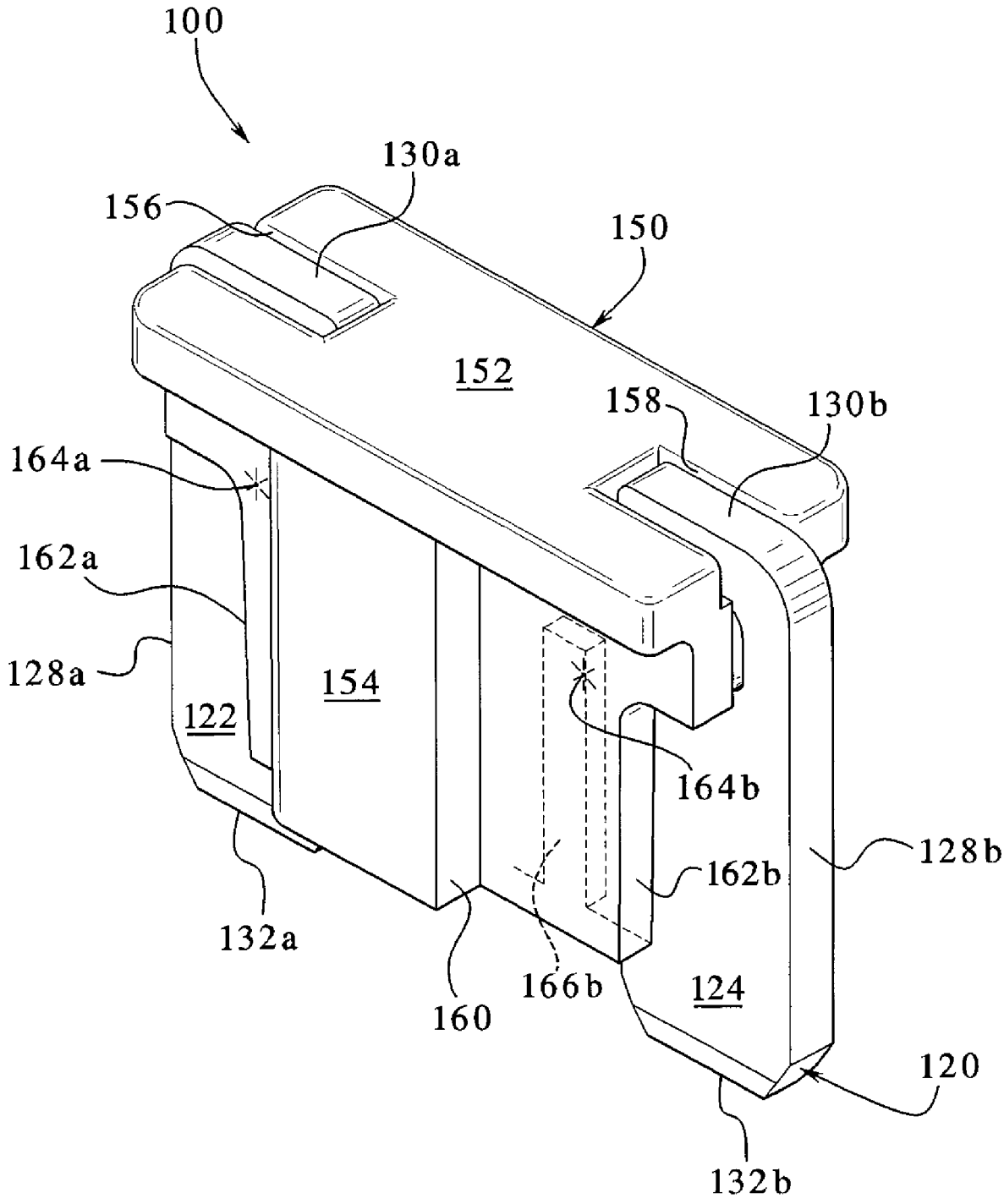

Housing 150 includes or defines mating inward projections or ribs 166*a* and 166*b* (projection 166*a* not seen in the perspective view of FIG. 17 but is formed in flange section 162*a* on back side of fuse 100). Projections 166*a* and 166*b* extend into grooves 136*a* and 136*b*. The interlocking relationship prevents terminal portion 120 from rotating within housing 150 along an axis through the front and back of fuse 100. Locating the interlocking projections/grooves on either side of fuse 100 also prevents terminal portion 120 from rotating within housing 150 along an axis through the top and bottom of fuse 100. In addition to rotational restraint, the grooves and projections constrain movement of the terminals within the housing translationally back-and-forth and side-to-side. The interlocking relationship of the projections/grooves is believed to provide a robust fuse 100. Terminals 122 and 124 will tend not to pivot and thus element 140 will tend not to bend.

Grooves 136*a*, 136*b* and projections 166*a*, 166*b* are at least substantially rectangular as illustrated, rounded, U-shaped, V-shaped, T-shaped, slotted or otherwise have any suitable interlocking shape. The interface between grooves and slots may be a press-fit interface or slightly less than press-fit as desired. A series of smaller grooves (e.g., rectangular or ovular) and smaller mating projections (e.g., rectangular or ovular) may be provided instead of one longer groove/projection interface. The grooves and projections can be provided on opposing sides of terminal portion 120 as illustrated, the same side of terminal portion 120 or on both sides of all terminals. In one preferred embodiment, at least two groove/projection interfaces are provided although a single interface would still be beneficial.

While grooves 136*a*, 136*b* and projections 166*a*, 166*b* are preferred in one embodiment, it is also possible that terminals 122 and 124 are provided with projections and housing 150 includes outwardly facing mating projections. For example, a portion of the inner edges 126*a* and 126*b* of terminals 122 and 124 could be bent one direction or the other at least substantially perpendicularly from terminals 122 and 124. Projections 160 extending outwardly from body 154 would then fit over and, e.g., provide an interference fit with the bent tabs.

Although staking is not needed, slots 134*a* and 134*b* coupled with stakes 164*a* and 164*b* provide further rigidity and robustness. Terminal portion 120 is centered within body 150. Element 140 is centered between terminals 122 and 124. This configuration evens the clearance between element 140 and housing 150, which reduces the possibility that element 140 will deform or melt either side of body portion 154 of housing 150 upon opening. Outwardly extending projections 160 also help in this regard.

Although not illustrated, housing 150 can include or define a tab at its bottom that extends across the opening shown defined by housing 150. That tab helps to collect any residue from the opening of fuse element 140 upon an overcurrent condition.

The present invention as described herein includes apparatuses 10, 100 as well as a method of manufacturing apparatuses 10, 100. As described, the method includes forming the individual pieces 20, 120 and 50, 150 and sliding housing 50, 150 over conductive portion 20, 120. The method then includes bending upper edges 30*a*, 130*a* and 30*b*, 130*b* inward to clamp the surface of notches 56, 156 and 58, 158 between upper edges 30*a*, 130*a* and 30*b*, 130*b* and intermediate surfaces 46*a*, 146*a* and 46*b*, 146*b*. The method can further include staking housing 150 at certain places coinciding with apertures or deformations formed in terminals 122 and 124.

Further, the method can include structuring housing 50, 150 so that the surface of top 52, 152 extends above bent upper end edges 30*a*, 130*a* and 30*b*, 130*b* to mitigate the risk of inadvertent arcing between terminals 22, 122 and 24, 124. Moreover, the method includes locating and exposing bent upper edges 30*a*, 130*a* and 30*b*, 130*b* so that the edges double as probe points for testing the integrity of the fuse.

It should be understood that various changes and modifications to the presently preferred embodiments described herein will be apparent to those skilled in the art. Such changes and modifications can be made without departing from the spirit and scope of the present invention and without diminishing its intended advantages. It is therefore intended that such changes and modifications be covered by the appended claims.

The invention is claimed as follows:

1. An automotive blade-type fuse comprising:

a plurality of metallic terminals separated by and in electrical communication with a fuse element; and an insulative housing covering at least a portion of an inner edge of each of the terminals and exposing the entire outer edges of the terminals and at least a portion of the upper edges of the terminals, the housing including a top defining first and second notches extending through first and second side edges of the top;

wherein the upper edges of the terminals are bent inward into the first and second notches to crimp the housing between a body portion of the terminals and the bent upper end edges.

2. The automotive blade-type fuse of claim 1, wherein at least one of the terminals defines at least one aperture and the housing is staked at a portion covering the at least one aperture.

3. The automotive blade-type fuse of claim 1, wherein the bent upper edges are located so as to provide probe points from which the integrity of the fuse element can be tested.

4. The automotive blade-type fuse of claim 1, wherein the top extends outward from front and back faces of the housing to increase rigidity of the housing.

5. The automotive blade-type fuse of claim 1, wherein viewing the terminals and housing from the front, the top extends above the bent upper edges so as to provide protection against an inadvertent electrical connection across the bent upper edges.

6. The automotive blade-type fuse of claim 1, wherein at least one of the front and back faces of the housing includes a projection to increase rigidity of the housing.

7. An automotive blade-type fuse manufacturing method comprising the steps of:

forming a pair of metallic terminals separated by and in electrical communication with a fuse element;

covering at least a portion of the of an inner edge of each of the terminals with an insulative housing and exposing the outer edges of the terminals and at least a portion of the upper edges of the terminals, the housing including a top defining first and second notches extending through first and second side edges of the top; and bending outer portions of the upper edges of the terminals inward into the first and second notches and crimping the housing between a body portion of the terminals and the bent upper end edges.

8. The automotive blade-type fuse manufacturing method of claim 7, which includes the step of staking the housing to at least one the terminals.

9. The automotive blade-type fuse manufacturing method of claim 7, which includes bending the upper edges so as to provide probe points from which the integrity of the fuse element can be tested.

10. The automotive blade-type fuse manufacturing method of claim 7, which includes extending the housing above the bent upper edges to provide protection against an inadvertent electrical connection across the bent upper edges.

* * * * *